US008684049B2

(12) United States Patent
Dreveton et al.

(10) Patent No.: US 8,684,049 B2
(45) Date of Patent: Apr. 1, 2014

(54) GAS CARTRIDGE ADAPTER FOR FIXING THE SAME TO A TRANSMISSION AND COMBUSTION CHAMBER FILLING MEMBER OF A GAS FIXING DEVICE AND FOR DISCONNECTING THE SAME FROM THE MEMBER

(75) Inventors: Jean Michel Dreveton, Valence (FR); Cyril Marion, Valence (FR); Frederic Nayrac, Bourg les Valence (FR); Patrick Herelier, Saint Jean de Muzols (FR)

(73) Assignee: Societe de Prospection et d'Inventions Techniques-Spit, Bourg les Valence (FR)

( * ) Notice: Subject to any disclaimer, the term of this patent is extended or adjusted under 35 U.S.C. 154(b) by 568 days.

(21) Appl. No.: 12/812,282

(22) PCT Filed: Feb. 12, 2009

(86) PCT No.: PCT/IB2009/050584

§ 371 (c)(1),
(2), (4) Date: Jul. 9, 2010

(87) PCT Pub. No.: WO2009/101598

PCT Pub. Date: Aug. 20, 2009

(65) Prior Publication Data

US 2010/0294798 A1 Nov. 25, 2010

(30) Foreign Application Priority Data

Feb. 14, 2008 (FR) ..... 08 00815

(51) Int. Cl.
*B65B 1/04* (2006.01)

(52) U.S. Cl.
USPC ..... 141/346; 141/383

(58) Field of Classification Search
USPC ..... 141/346, 383; 227/9, 10; 137/332; 251/149.6
See application file for complete search history.

(56) References Cited

U.S. PATENT DOCUMENTS

| | | | | | |
|---|---|---|---|---|---|
| 925,959 | A | * | 6/1909 | Smith | 285/280 |
| 4,123,091 | A | | 10/1978 | Cosentino et al. | |
| 4,436,125 | A | * | 3/1984 | Blenkush | 141/330 |
| 4,682,798 | A | | 7/1987 | Sauer | |
| 4,775,173 | A | | 10/1988 | Sauer | |
| 5,090,747 | A | * | 2/1992 | Kotake | 285/305 |

FOREIGN PATENT DOCUMENTS

| | | | |
|---|---|---|---|
| CN | 1494258 | A | 5/2004 |
| CN | 1953846 | A | 4/2007 |
| DE | 2611233 | A1 | 9/1977 |

(Continued)

OTHER PUBLICATIONS

ISR for PCT/IB2009/050584 dated Jul. 9, 2009.

(Continued)

*Primary Examiner* — Jason K Niesz
(74) *Attorney, Agent, or Firm* — Lowe Hauptman & Ham LLP

(57) ABSTRACT

The adapter comprises a central tubular body extending on one side with an abutment and fixing base on the cartridge and, on the other side, with two fixing legs on an intermediary nose piece of the transmission and filling member able to be hinged for ensuring the fixing operation, disconnecting and ejecting wings being additionally provided. The disconnecting and ejecting wings are arranged for opening the fixing legs before driving them into translation.

6 Claims, 9 Drawing Sheets

(56) References Cited

FOREIGN PATENT DOCUMENTS

| | | | |
|---|---|---|---|
| FR | 2558563 | A1 | 7/1985 |
| FR | 2884749 | A1 | 10/2006 |
| WO | 2006114695 | A2 | 11/2006 |

OTHER PUBLICATIONS

French Search Report for FR0800815 dated Oct. 16, 2008.
Office Action, CA Application No. 2,711,598, dated Nov. 10, 2011.

* cited by examiner

GAS CARTRIDGE ADAPTER FOR FIXING THE SAME TO A TRANSMISSION AND COMBUSTION CHAMBER FILLING MEMBER OF A GAS FIXING DEVICE AND FOR DISCONNECTING THE SAME FROM THE MEMBER

RELATED APPLICATIONS

The present application is national phase of International Application Number PCT/IB2009/050584, filed Feb. 12, 2009, and claims priority from, French Application Number 0800815, filed Feb. 14, 2008, the disclosures of which are hereby incorporated by reference herein in their entirety.

This present application invention relates to a gas cartridge adapter of the type as described in the French Patent Application 0 504 155, for connecting the cartridge with a transmission and combustion chamber filling member of a gas fixing device, the member consisting generally in a solenoid valve.

Gas fixing devices include, for example, nailing machines, hammers and similar staplers.

Such devices comprise a housing for receiving a cartridge maintained in such a housing by means being integral with the devices, such as a hatch, a hood, a fork being slipped into a groove of the cartridge ejecting nose piece, for example.

In operation, the cartridge et the solenoid valve are connected to one another tightly by means of a linking adapter, being integral with the cartridge, fixed to an intermediary intake nose piece integral with the solenoid valve.

The invention according to the Application 0 504 155 has provided a solution to the problem of extracting the cartridge from its housing in the device.

As part of such a solution, there has been provided a particular cartridge adapter.

Referring to FIG. 1, taken from the Application 0 504 155, the adapter 2 is used for mutually fixing the cartridge 20 and the solenoid valve 30.

The cartridge 20, of a cylindrical general shape, comprises, in an internal shell, the pressurized gas in the liquid state and, between the internal shell and an external shell 22, a propeller. A circular flange 21 extends within the continuation of the external cylindrical wall of the cartridge 20, at one of the ends thereof. A male ejecting nose piece, connected with the internal shell, protrudes outside the cartridge, through a base 24 located in the centre of the cup arranged inside the flange 21.

The solenoid valve 30, of a cylindrical general shape, comprises at one of its ends, an intake nose piece, connected, inside the solenoid, with an exhaust nose piece, not shown.

The intake nose piece is here a male nose piece.

The adapter 2 comprises a planar abutment base 5, here being circular, to which are connected fixing legs extending into the flange internal cup perpendicularly to the base and mutually spaced apart for engaging the internal wall of the flange 21.

On the other side of the fixing legs, the abutment base 5 extends through a tubular chimney 6 of a section significantly smaller than the base 5. This is the adapter central tubular body. Such a chimney is split in an axial plane for releasing two fixing legs 8, 9 slightly hinged substantially at half-length of the chimney. The free ends 10, 11 of the fixing legs are shaped as semi-circular beads, each providing an internal circular shoulder for fixing a spherical member of the solenoid valve intermediary nose piece. Outside, there is provided in the free ends 10, 11 of the fixing legs 8, 9, a peripheral groove 12 for receiving an O-ring (not shown) for clamping legs one to the other. In order to allow them for being hinged, the fixing legs are partially recessed for having an overall inverted U shape being hinged around the ends 13 of both parallel arms of the U-shaped member.

From the internal portion of the recessed windows 14 of both fixing legs 8, 9, ribs or wings 15, 16 protrude radially outwards, in the same axial plane, for providing transversal end bosses 17, 18 slightly disengaged from the chimney 6, extending substantially in the transversal plane of the groove 12 and adapted to be received in side groove bottoms of an indexing and blocking skirt 3 arranged on the solenoid valve 30. Such end bosses play a part in ejecting the cartridge from its housing case.

When the operator pushes on a pusher 61, he drives the latter into a transversal shift, which, through ramps and ribs of a ring 62 and thus, through a wedge effect, is converted into an axial shift driving the ejecting ring 62 on the outside.

Through its annular flange 72, the ring 62 drives, through their bosses 17, 18, the wings 15, 16 of the adapter 2 and thus, the cartridge 20 outside for ejecting it outside its housing case.

The disconnecting wings for the adapter are integral with the tubular chimney of the adapter, of the body itself of the adapter. Consequently, the effort to be implemented for ejecting the cartridge is quite significant.

The invention of the present application aims at reducing such an ejecting effort.

Thus, the present invention relates to a gas cartridge adapter for fixing the to same on a transmission and combustion chamber filling member of a gas fixing device and for disconnecting the same from the member, comprising a central tubular body extending on one side by an abutment and fixing base on the cartridge and, on the other side, by two fixing legs on an intermediary nose piece of the transmission and filling member and able to be hinged for implementing the fixing, disconnecting and ejecting wings being additionally provided, such an adapter being characterized in that the disconnecting and ejecting wings are arranged for opening the fixing legs before driving the latter into translation.

Thus, through the hinging ability of the fixing legs, any action of the ejecting device on the wings first results in the fixing legs being rotated, releasing the adapter from the intermediary nose piece of the transmission and filling member and then allows for an easy translation driving of the cartridge outside its housing case. In other terms, the breaking of the cooperation between the adapter and the intermediary nose piece is no longer implemented through a single thrust, but continues. The clip formed by the fixing legs is first opened.

Preferably, disconnecting and ejecting wings are arranged on the fixing legs.

This invention will be better understood referring to the following description which, for consistency and simplification reasons, is based on numerous passages of the disclosure of the Application 0 504 155 and more specifically those relating to the connecting parts and the disconnecting and ejecting mechanism of the cartridge. Thus, such parts and mechanism are disclosed referring to the embodiment of the adapter of said prior art application, although it is not claimed here, but these apply equally well to the embodiment of the adapter of the present application.

The description will be made referring to the accompanying drawing, in which.

Figure 1:
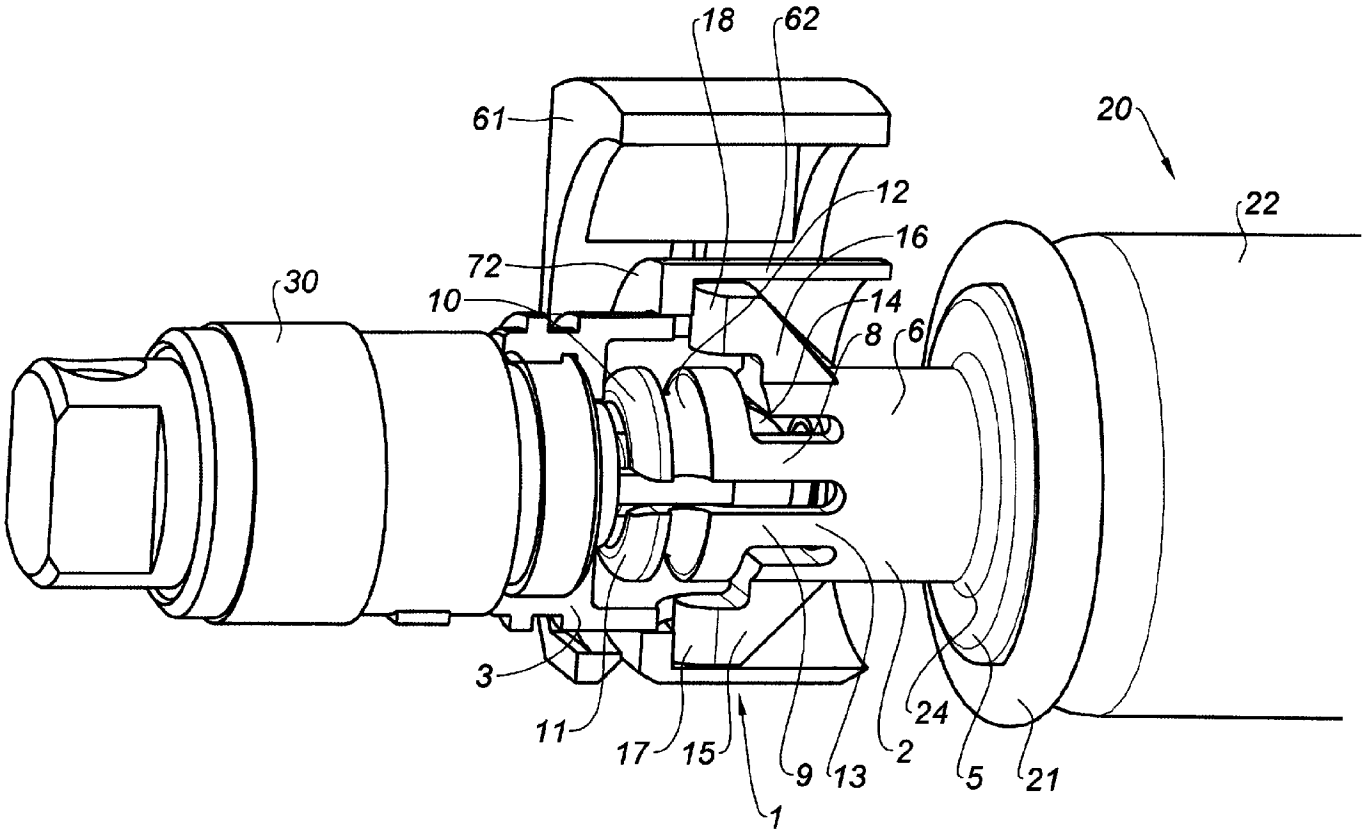
Fig. 1 Prior Art
FIG. 1 is a cutaway perspective view of a cartridge with the prior art adapter and the cartridge ejecting mechanism, before ejection.
Figure 2:
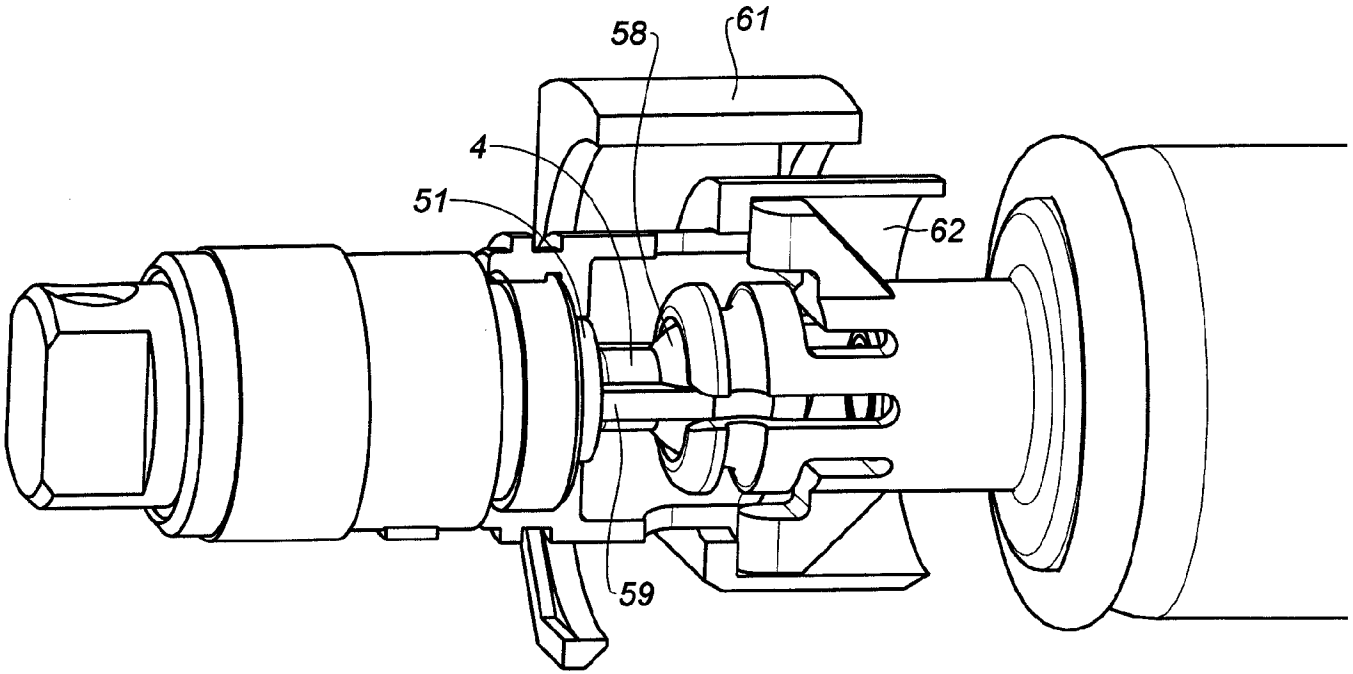
Fig. 2 Prior Art
FIG. 2 is a view similar to that in FIG. 1, but after the operation of the ejecting mechanism.

Referring to FIG. 1, the connecting parts of the cartridge 20 and the solenoid valve 30 comprise:

- a fixing, angular indexing and rotation blocking adapter 2, here mounted on the cartridge 20,
- an angular indexing and rotation blocking skirt 3, here mounted on the solenoid valve 30,
- an intermediary nose piece 4, mounted on the solenoid valve 30, and
- a seal gasket, mounted in the adapter 2.

The adapter 2 has already been described herein above.

Regarding the indexing and blocking skirt 3, this is an overall tubular member, with, on one side, an end 41 for fixing on the solenoid valve and, on the other side, indexing wings 42-43, formed in a tubular portion, being thicker than the fixing portion, with the same internal wall and thus providing an external annular shoulder 44. Overall, such indexing wings 42, 43 have been obtained through intersecting said thick tubular portion by a tubular member with an axis orthogonal to the axis of the skirt, releasing edges 45 serving as angular indexing ramps. Each indexing wing has two ramp portions 45 being tilted in an inverted direction with an apex roundness between them and extending substantially over 180°. In the axial plane separating both wings 42, 43 two anti-rotation side grooves 46 have been cut, each extending in the same axial plane, down to a bottom part 47 in the thin fixing tubular portion 41.

The intermediary nose piece 4 is a small tubular column 4 with, at one end, a sleeve portion 51 for covering the solenoid valve nose piece. The intermediary small column 4 comprises, at the other end, a small end tubular portion 57 adapted to be introduced in the seal gasket. Adjacent to the end portion 57, there is provided a fixing sphere portion 58, connected with the sleeve portion 51 through the small column 4 and two positioning ribs 59.

From one end to the other, through the small column 4, a gas passage channel extends.

The seal gasket is a generally tubular shaped coupling.

Figure 3:
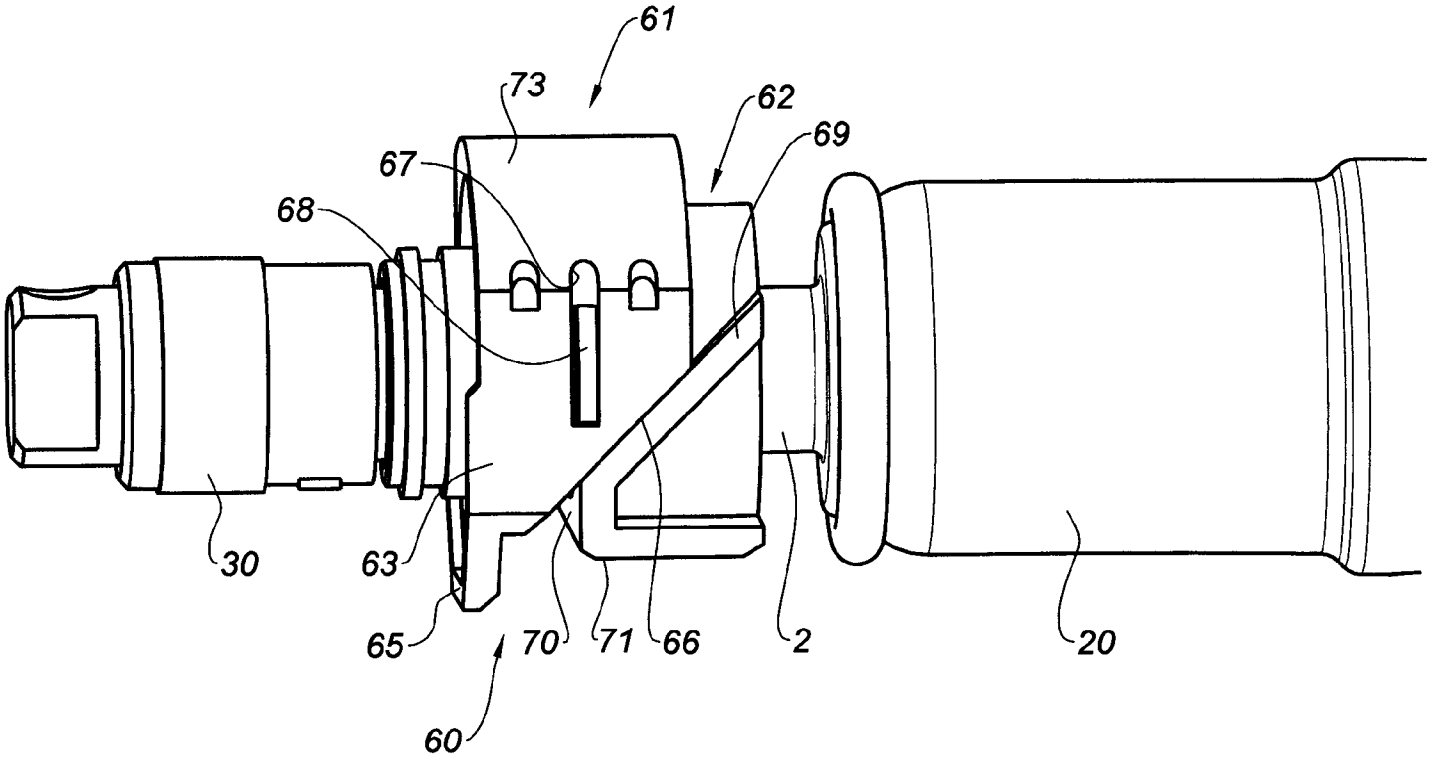
Fig. 3 Prior Art
FIG. 3 is a side view of the cartridge and the ejecting mechanism.
Figure 4:
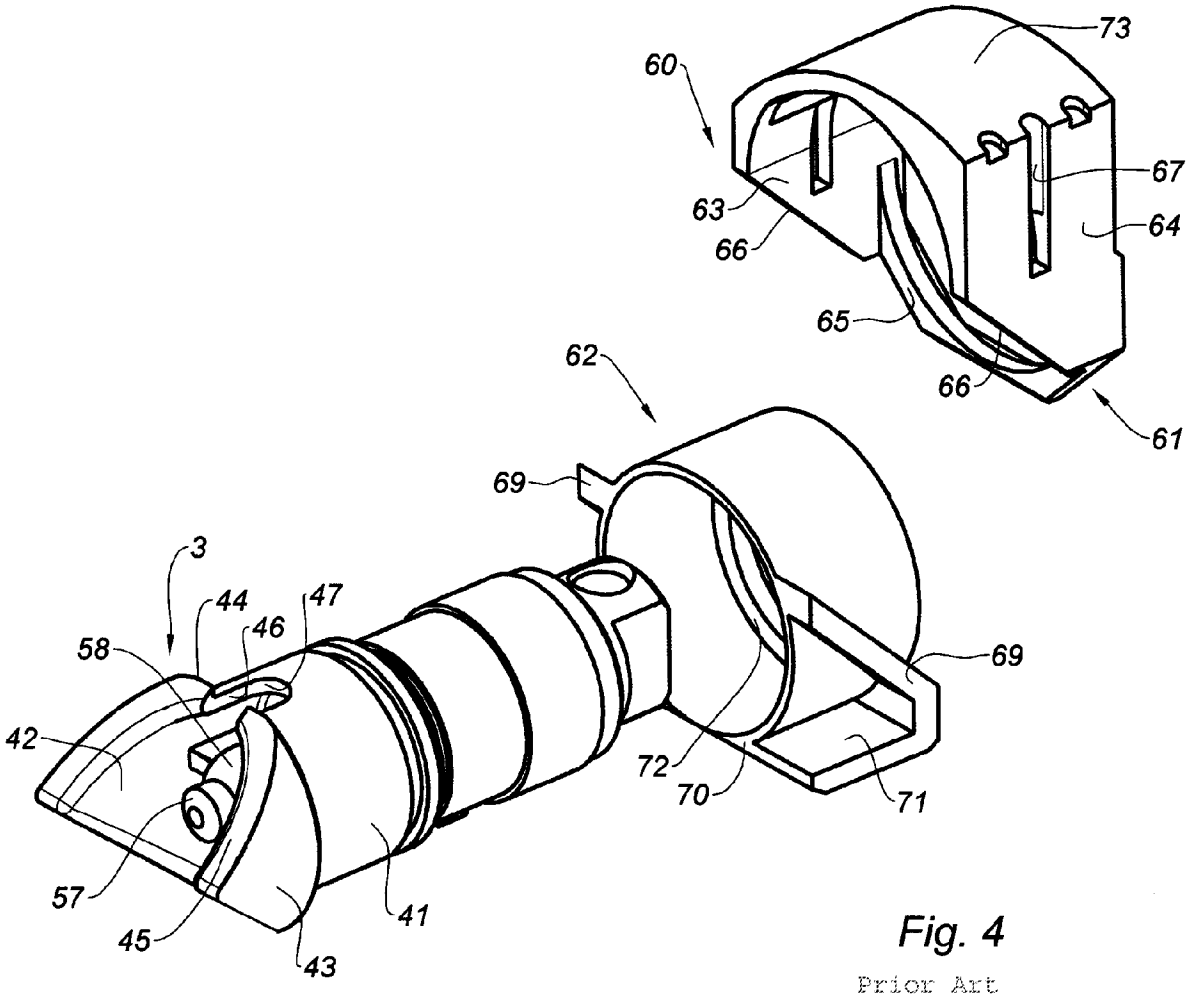
Fig. 4 Prior Art
FIG. 4 is an exploded view of the ejecting mechanism while the solenoid valve is being assembled in the housing case.

The disconnecting and ejecting mechanism (FIG. 3) is mounted on the case 80 for housing the cartridge 20 and the solenoid valve 30. This is an elongated case with a length substantially equal to the sum of the lengths of the cartridge 20, of the adapter thereof 2 and of the solenoid thereof 30. The case 80, of a parallelepiped general shape, comprises a cradle-shaped bottom 81 for receiving the cartridge, said bottom being bored with a lumen 82 adapted to let pass a pusher 61 intended to disconnect the adapter of the cartridge 2 from the intermediary nose piece of the solenoid valve 4 by means of an ejecting ring 62.

The pusher 61 comprises a cylindrical skirt portion 73 being extended with two planar side flank portions 63, 64 joined together by a ring portion 65. The pusher axially extends over a small length from the plane of the ring 65. The cylindrical skirt portion 73 is shaped so as to plug the passage lumen 82 bored in the bottom 81 of the case.

The ring portion 65, in the plane thereof, completes the cylinder of the skirt portion 73 for receiving the adapter 2 of the cartridge 20.

The side flanks 63, 64 have a trapezoid general shape, having each an edge 66 being tilted to the back and outside and serving as a ramp member for a wedge effect with the ejecting ring. A groove 67 is arranged in each of the planes for receiving a corresponding rib 68 protruding outside the internal wall of the case cradle and thus guiding the pusher 61 slipping during the actuation thereof.

The ejecting ring 62 is a tubular member onto which there are arranged, laterally and outside, but here as a monobloc, two rearwards and outwards tilted ribs 69 and intended to cooperate with the edges 66 of the pusher device 61 for creating a wedge effect. The ribs 69 are joined by a transversal planar portion 70 and a plate 71 substantially tangent to the tubular portion of the ring. The linking planar portion 70 is extended, in the plane thereof, by an internal annular flange 72 for pushing and driving the cartridge.

The pusher 61 and the ring 62 make up a mechanism for converting an inwards transversal motion of the case bottom—when the pusher 61 is being pushed for being shifted transversally to the axis—into an ejecting orthogonal motion, in such a case, in a direction parallel to the axis by means of the wedge effect exerted by the ramps 66 of the pusher 61 and the ribs 69 of the ring 62.

The pusher 61 and the ring 62 are free in their housing in the transversal direction. Whatever the position of such an assembly, the introduction of the cartridge acts, by means of the bosses 17, 18, on the flange 72 of the ring 62, driving the pusher 61 through a wedge effect and positioning again the assembly 61, 62.

Figure 5:
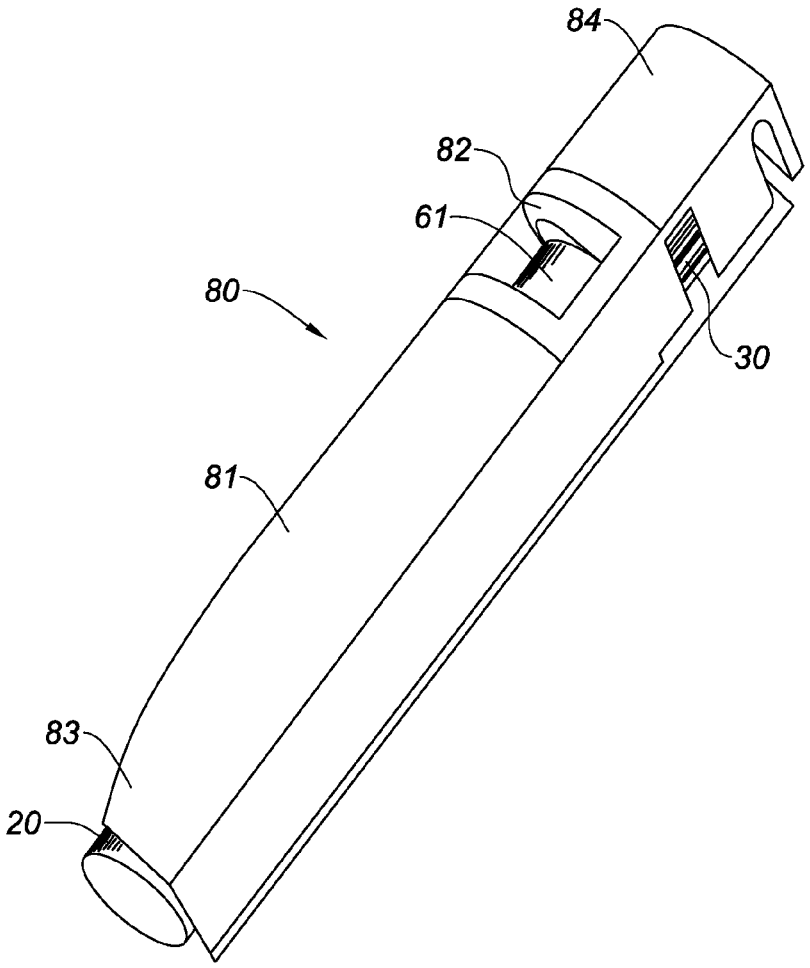
Fig. 5 Prior Art
FIG. 5 is a perspective view of the housing case with the cartridge and the solenoid valve.
Figure 6:
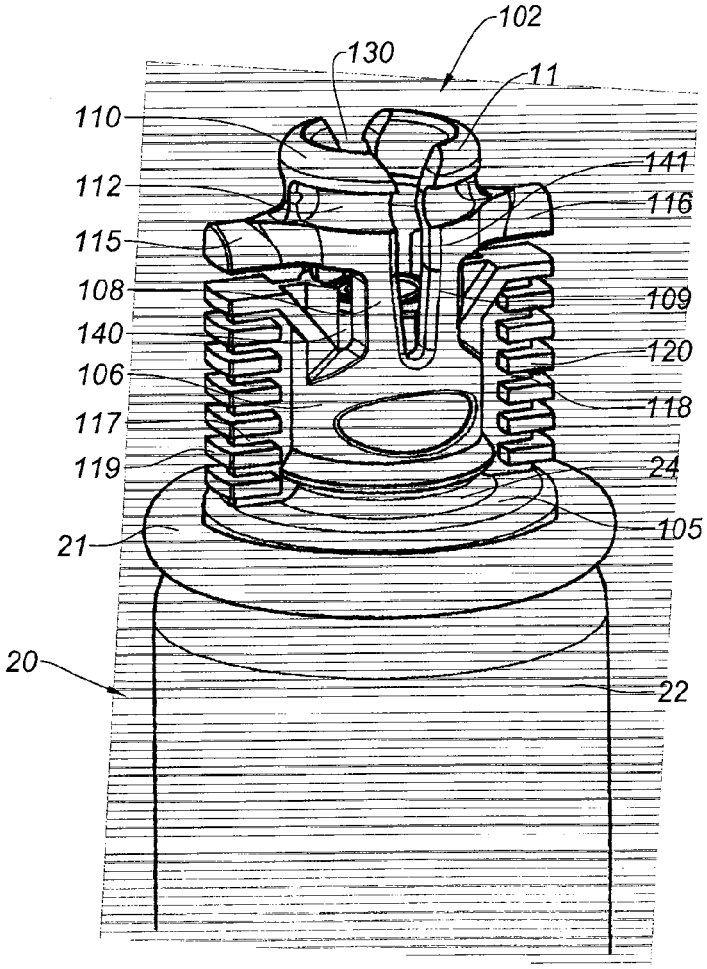
FIG. 6 is a perspective view of the adapter of this invention.
Figure 7:
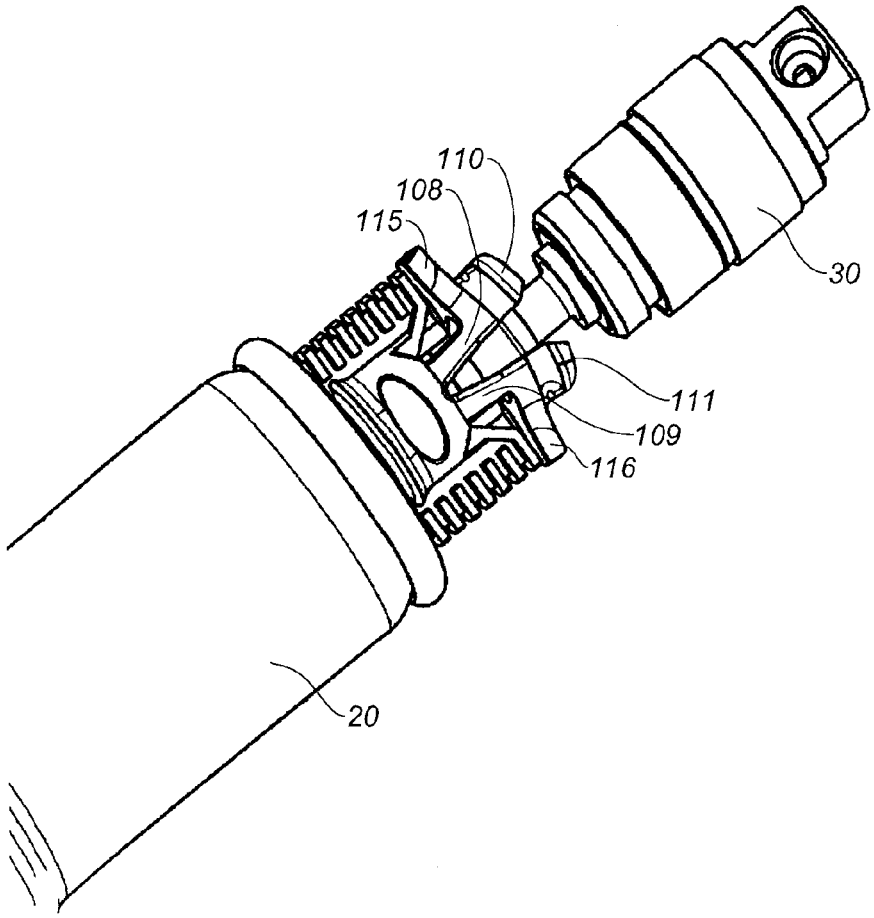
FIG. 7 is a perspective view of the adapter of this invention during fixing on the intermediary nose piece of the solenoid valve.
Figure 8:
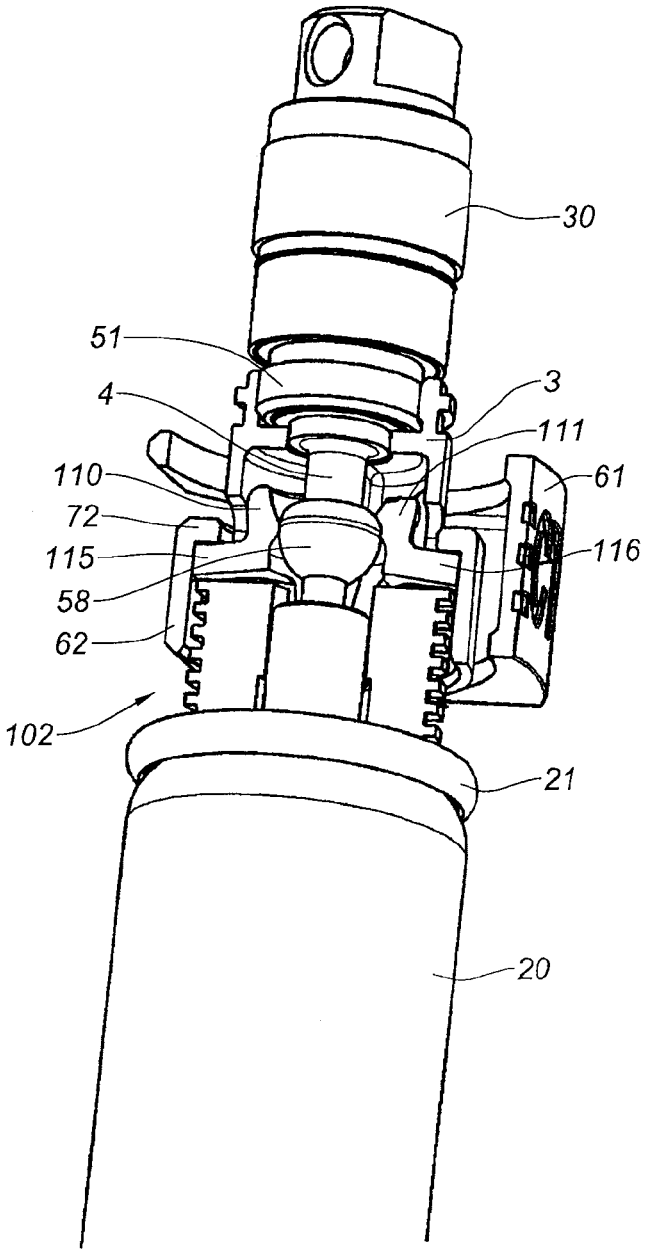
FIG. 8 is a cutaway perspective view of the adapter and the ejecting mechanism, while the adapter is being disconnected.
Figure 9:
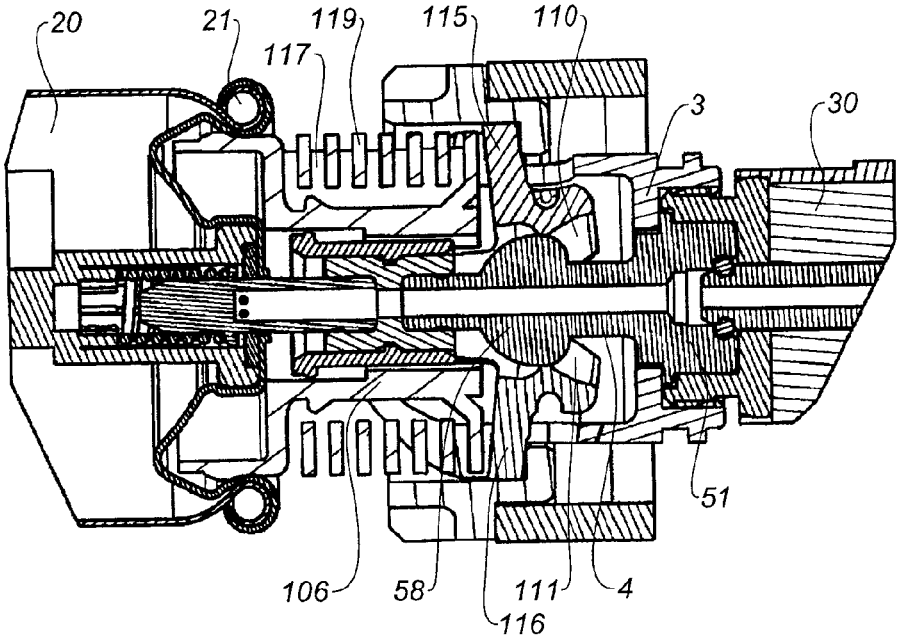
FIG. 9 is a corresponding axial sectional view of the adapter and the ejecting mechanism, while the adapter is disconnected, corresponding to FIG. 8.

In FIG. 5, the pusher device 61 is in a re-entrant position, the cartridge 20 being itself not yet in a connecting position.

Connecting the solenoid valve 30 and the cartridge 20 will now be described.

After introducing the intermediary nose piece 4, through the sleeve thereof 51, into the solenoid valve 30, the latter is being capped by the skirt 3 through a fixing operation, by the end 41 of the skirt 3 on the solenoid valve, here through screwing the end 41 of the skirt 3, here threaded, on the threaded edge of the solenoid valve.

Afterwards, the solenoid valve 30, with its indexing and blocking skirt 3, is being placed in the housing case 80, being introduced from the rear 83 to the front 84 through the ejecting ring 62 and the ejecting pusher 61, the solenoid valve resting then on supporting circular transversal ribs.

The adapter 2 being overall mounted on the cartridge 20, after introducing the cartridge in its housing case in the device, it is pushed towards the solenoid valve.

If the angular position of the cartridge is not appropriate, the wings 15, 16 of the adapter 2, by means of their end bosses 17, 18, will come in abutment against the edges 45 of the skirt. Because of their tilting, while pushing further the cartridge towards the solenoid valve, the wings 15, 16 will slip on the edges 45 and, through a ramp effect, this will result in the cartridge rotating, that is until the wings engage the side grooves 46 of the skirt 3. As soon as the wings 15, 16 come into engagement into the grooves 46 of the skirt 3, the cartridge being then rotation blocked, the fixing legs 8, 9 of the adapter 2 come into contact with the sphere portion 58 of the intermediary nose piece 4, spacing them apart until, under the action of the return core, not shown, when the portion of the sphere being at the level of the recessed windows 14, they become clamped on such a sphere portion for providing for the fixing of the adapter of the cartridge on the intermediary nose piece of the solenoid valve, that is the connexion of the cartridge 20 and of the solenoid valve 30. Then the wings 15, 16, through their end bosses 17, 18 come into abutment against the annular flange 72 of the ejecting ring 62, being in turn in abutment against the ring 65 of the pusher 61.

The disconnecting operation of the cartridge 20 from the solenoid valve 30 will be now described.

When the operator pushes on the pusher 61, he drives the latter into a transversal shift, which, through its ramps 66 and the ribs 69 of the ring 62 and thus, through a wedge effect, is converted into an axial shift driving the ejecting ring 62 outside.

The adapter of the present application will be now described, to which adapter perfectly apply the hereinabove described connecting parts and the disconnecting mechanism.

Identical members on FIG. 1-5, on the one hand, and FIG. 6-9, on the other hand, have the same numerical references.

The adapter 102 in FIGS. 6 to 9 comprises an abutment base 5, here also circular, to which are connected fixing legs extending into the flange internal cup perpendicularly to the base and mutually spaced apart for engagement of the internal wall of the lip 21. On the other side of the fixing legs, the abutment base 105 extends by a central tubular body 106 with a section significantly smaller than the base 105. The central body 106 is split in an axial plane for releasing two fixing legs 108, 109 hinged substantially at half length of the body. The free ends 110, 111 of the fixing legs are pressed into semi-circular beads, each providing an internal circular shoulder for fixing a spherical member 58 of the solenoid valve 30 intermediary nose piece 58.

Outside, there is provided in the free ends 110, 111 of the fixing legs 108-109, a peripheral groove 112 for receiving an O-ring (not shown) for clamping legs one to the other.

In order to make their hinging easier, the fixing legs 108, 109 are partially recessed (140, 141) showing each a ring-shaped rough structure. In their area adjacent to the corresponding bead, the legs have a wing 115, 116 performing the same function as the above described wings 15, 16. Overall, such wings 115, 116 extend in a plane orthogonal to that of the slot 130 arranging the legs 108, 109 into a radial projection outside the plane of the rings of the annular legs 108, 109.

Between each wing 115, 116 and the base 105 of the adapter, a side rib 117, 118 with wings 119, 120 superimposed one on the other, extends in an axial plane perpendicular to the plane of the slot 130.

Connecting the solenoid valve 30 and the cartridge 20 occurs as previously.

The adapter 2 being overall mounted on the cartridge 20, after introducing the cartridge in its housing case in the device, it is pushed towards the solenoid valve.

If the angular position of the cartridge is not appropriate, the wings 115, 116 of the adapter 102 will come in abutment against the edges 45 of the skirt. While pushing further the cartridge towards the solenoid valve, the wings 115, 116 will slide on the to edges 45 and, through a ramp effect, this will result in the cartridge rotating, that is until the wings engage the side grooves 46 of the skirt 3. As soon as the wings 115, 116 come into engagement into the grooves 46 of the skirt 3, the cartridge being then rotation blocked, the fixing legs 108, 108 of the adapter 102 come into contact with the sphere portion 58 of the intermediary nose piece 4, spacing them apart until, under the action of the return core, not shown, when the portion of the sphere being at the level of the recessed windows 140, 141, they become clamped on such a sphere portion for providing for the fixing of the adapter of the cartridge on the intermediary nose piece of the solenoid valve, that is the connexion of the cartridge 20 and the solenoid valve 30. Then, the wings 115, 116 are in abutment against the annular flange 72 of the ejecting ring 62, being in turn in abutment against the ring 65 of the pusher 61.

The disconnecting operation of the cartridge 20 from the solenoid 30 will be now described.

When the operator pushes on the pusher 61, he drives the latter into a transversal shift, which, through its ramps 66 and the ribs 69 of the ring 62 and thus, through a wedge effect, is converted into an axial shift driving the ejecting ring 62 outside. With such a motion, it rotates the wings 115, 116 opening the fixing legs 108, 109, releasing the beads 110, 111 from the sphere 58 of the intermediary nose piece.

Through its annular flange 72, the ring 62 drives the wings 115, 116 of the adapter 102 and thus the cartridge 20 outside for ejecting the latter outside its housing case. Releasing the beads 110, 111 from the sphere 58, driving the cartridge occurs without any effort.

The invention claimed is:

1. An adapter for a gas cartridge configured to removably attached on a transmission and filling member of a gas fixing device for filling a combustion chamber thereof and for disconnecting the same from the transmission and filling member, comprising:

a central tubular body having a first end and a second end opposing said first end, an abutment fixing base at said first end for attaching to said gas cartridge, said central tubular body comprising a pair of legs, wherein said pair of legs are configured to be secured on an intermediary end piece of the transmission and filling member, a slot extending longitudinally between said pair of legs, a pair of ejecting wings positioned in an area adjacent to said second free end opposite said first end of said legs, wherein said pair of wings extend radially outwardly in a plane orthogonal and to that of said longitudinal slot, and, wherein said legs are partially recessed having a ring-shaped structure.

2. An adapter according to claim 1, wherein the free ends of fixing legs include an arcuate surface.

3. The adapter of claim 1, wherein said pair of ejecting wings is integrally formed with said pair of legs.

4. In combination, an adapter according to claim 1, and a gas cartridge, said gas cartridge being fixed on the abutment and fixing base.

5. The combination of claim 4, wherein said transmission member further comprises a ring member configured to rotate said pair of wings as said ring is axially shifted and opening said pair of legs apart from one another.

6. A gas fixing device, comprising:

an adapter according to claim 1, a gas cartridge, said gas cartridge being fixed on the abutment and fixing base of the adapter, a transmission member comprising a ring member configured to rotate said pair of wings as said ring is axially shifted and opening said pair of legs apart from one another.

* * * * *